US007661925B2

(12) United States Patent
Lejars et al.

(10) Patent No.: US 7,661,925 B2
(45) Date of Patent: Feb. 16, 2010

(54) VARIABLE-SETTING STATOR BLADE GUIDANCE DEVICE IN AN AXIAL TURBOMACHINE

(75) Inventors: Claude Robert Louis Lejars, Draveil (FR); Thierry Jean Maurice Niclot, Savigny sur Orge (FR); Didier Raymond Charles Riby, Boissise le Roi (FR); Richard Staessen, Chailly En Biere (FR)

(73) Assignee: SNECMA, Paris (FR)

( * ) Notice: Subject to any disclaimer, the term of this patent is extended or adjusted under 35 U.S.C. 154(b) by 463 days.

(21) Appl. No.: 11/549,270

(22) Filed: Oct. 13, 2006

(65) Prior Publication Data

US 2008/0025837 A1 Jan. 31, 2008

(30) Foreign Application Priority Data

Oct. 18, 2005 (FR) ..... 05 53159

(51) Int. Cl.
*F01D 9/00* (2006.01)

(52) U.S. Cl. ..... 415/161

(58) Field of Classification Search ..... 415/160, 415/161, 165; 384/275, 276, 420, 425
See application file for complete search history.

(56) References Cited

U.S. PATENT DOCUMENTS 1,685,260 A 9/1928 White
4,498,790 A * 2/1985 Fisher ..... 384/428
4,856,962 A 8/1989 McDow
5,094,550 A * 3/1992 Momose et al. ..... 384/420
5,174,660 A * 12/1992 Seibig ..... 384/420
5,807,072 A * 9/1998 Payling ..... 415/170.1
6,767,183 B2 * 7/2004 Schilling et al. ..... 415/160

FOREIGN PATENT DOCUMENTS

| | | |
|---|---|---|
| AU | NR. 321224 | 3/1975 |
| DE | 2113194 | 9/1972 |
| EP | 1 400 659 A1 | 3/2004 |
| EP | 1 584 827 A1 | 10/2005 |

* cited by examiner

*Primary Examiner*—Ninh H Nguyen
(74) *Attorney, Agent, or Firm*—Oblon, Spivak, McClelland, Maier & Neustadt, L.L.P.

(57) ABSTRACT

A variable-setting stator blade guidance device of an axial turbomachine is provided. The blade includes an airfoil, a platform and a pivot mounted in the casing of the turbomachine. The device includes a bearing integrated into the platform. In particular, the device includes a bush sandwiched between the platform and the casing, and the integrated bearing is formed between the bush and the platform. In particular, the bush includes a cylindrical surface portion on the side of the platform cooperating with a matching cylindrical surface portion on the platform to form the integrated bearing.

11 Claims, 1 Drawing Sheet

VARIABLE-SETTING STATOR BLADE GUIDANCE DEVICE IN AN AXIAL TURBOMACHINE

The present invention relates to the field of turbomachines such as an axial compressor of a gas turbine engine, and aims in particular at variable-setting stator blades.

An articulated system, such as the variable-setting stator blades of a gas turbine engine compressor, comprises portions that move relative to one another. FIGS. 1 and 2 show schematically a variable-setting stator blade 1 mounted in the casing 3 of the machine. The blade comprises an airfoil 12, a plate or platform 13, and a shank forming a pivot 14. The pivot 14 is housed in a bore or radial orifice made in the wall of the casing 3 by means of various bearings. One of the bearings, the bottom bearing, consists of a bush 4 in sliding contact with the bottom portion of the shank forming the pivot 14, directly or via a shrink-fitted band 14'. The bush 4 is fixedly attached to the casing and comprises a portion 4' housed in the bottom of a facing machined in the wall of this casing. It is radially in contact with the platform 13. The top portion of the pivot 14 is held in a top bearing formed by a bush 5. The face of the platform 13 opposite to the bush forms the base of the airfoil and is swept by the gases passing through the turbomachine. A nut 15 holds the blade in its housing. A lever 19, itself actuated by control members, controls the rotation of the blade about the axis XX of the shank to place the latter in the required position relative to the direction of the gaseous flows. The relative movements result from the sliding of the contact surfaces relative to one another.

An exemplary embodiment of such a system with incorporation of bushes between the blade and the casing is described in patent application EP 1 584 827 in the name of the applicant.

In the case of a gas turbine engine compressor, the airfoil 12 is subjected to the aerodynamic forces in the direction of the arrow A. In the case of such a cantilever-mounted assembly, it follows that the application of a moment to the two bearings, bottom and top, associated with the setting rotation about the axis XX over an amplitude of more than 40 degrees, causes wear of the bushes. This wear causes an inclination of the blades which may be harmful for the compressor.

The present applicant has set itself the objective of guiding the variable-setting stator blades of the cantilever-mounted type while preventing these disadvantages, namely:

The wear of the bushes of the guidance device creating an excessive inclination of the blades under the aerodynamic force.

The increased operating forces of the variable-setting stator blades.

The invention achieves these objectives with a guidance device characterized in that the blade comprises an airfoil, a platform and a pivot by which the blade is mounted in the casing of the turbomachine, in that it comprises a bush with a disk-shaped portion between the casing and the platform, an annular rib being made on said disk-shaped portion interacting with a matching groove made on the platform, so as to form a smooth bearing between them.

By means of the invention, the distance is reduced between the point of application of the aerodynamic force and the bearing of the pivot guidance device situated at the bottom of the pivot. This height reduction reduces the moment applied to the blade. It follows that the reaction force at the pivot to oppose the moment is weaker. Thus the mating forces at the contacts between the blade pivot and the bush are weaker, hence reduced wear.

The device comprises where necessary a top bearing between the top portion of the pivot and its housing in the casing.

According to an advantageous embodiment, the guidance device comprises a bottom bearing between the bottom portion of the pivot and its housing in the casing. It makes it possible to further reduce the loads on the bushes by spreading them.

Other features and advantages will appear on reading two nonlimiting embodiments of the invention with reference to the appended drawings in which.

Figure 2:
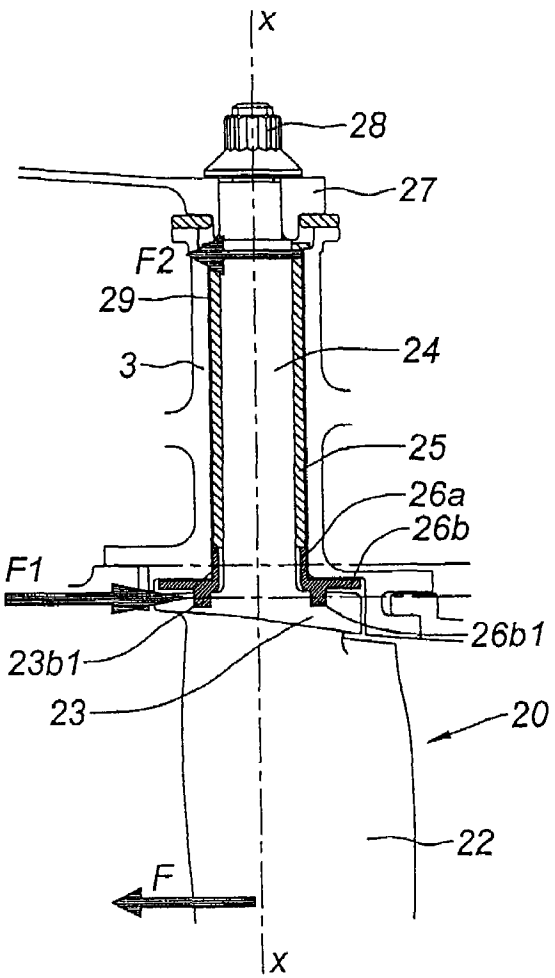
FIG. 2 represents a variable-setting stator blade with a guidance device according to a first embodiment.
Figure 1:
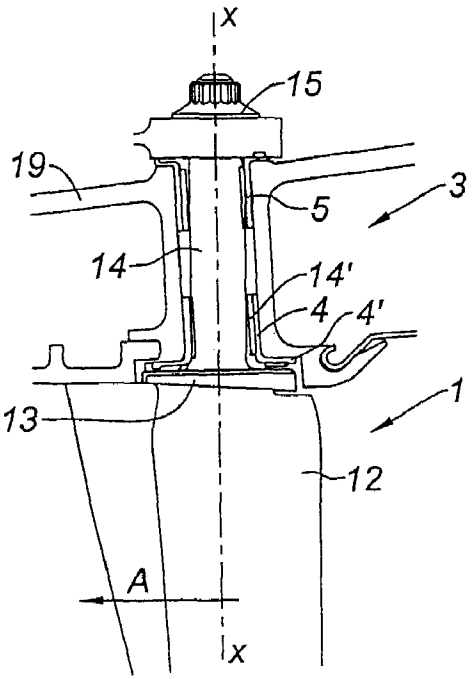
Fig. 1 BACKGROUND ART
FIG. 1 represents a variable-setting stator blade of the prior art, mounted in a compressor casing.

FIG. 2 shows a variable-setting, cantilever-mounted stator blade 20 with an airfoil 22, a platform 23 and a pivot 24. The pivot 24 is housed in a radial bore of the casing 3 which is for example that of the compressor of a gas turbine engine. The blade is held by a nut 28 in its top portion and connected to a setting control lever 27 as is known. The terms "top" and "bottom" indicate the position relative to the axis of the engine, a top element being further from the axis than a bottom element. The blade guidance device here consists of a cylindrical bush 25 between the pivot 24 and the housing in the casing 3. This bush also provides the seal. A bush 26 in the bottom portion of the pivot comprises a cylindrical portion **26*a* between the bottom portion of the pivot and the housing in the casing. The bush is extended by a generally disk-shaped portion 26*b* between the platform 23 and the bottom of the facing of the casing forming the housing of the latter. According to the invention, a bearing is formed at the platform. According to this embodiment, the bearing is formed by the interaction of a rib 26*b*1 and a groove 23*b*1. The circular rib is made on the face of the bush turned toward the platform 23. The term "circular" also comprises the embodiment in which the rib extends over one or more arcs of circles. According to this example, this rib has a square section and is adjusted in the matching-shaped groove 23*b*1, hollowed out in the face of the platform turned toward the bush 26. The two portions, rib and groove, form an integrated bearing 23*b*1-26*b*1 which sustains the aerodynamic forces applied to the airfoil and transmits them to the casing 3**.

Note that, in this embodiment, there is no sliding contact between the bottom portion of the pivot 24 and the bush **26*a*. The top portion of the pivot forms a top bearing 29**.

Note also that the radius of the integrated bearing is chosen so that the frictions between the rib **26*b*1 of the bush 26 and the groove 23*b*1 of the platform induce a resistance to the axial pivoting of the blade that is acceptable and does not disrupt the operation of the setting control means. During the rotation of the blade about its axis, the bush 26** remains immobile relative to the casing.

As an example, the advantage of this disposition has been calculated: the forces present are the aerodynamic force F, the reaction force F1 of the casing on the bottom portion of the guidance device and the reaction force F2 of the casing on the top portion of the guidance device.

L, 50 mm, is the distance between the point of application of F and the bottom bearing; L1, 40 mm, is the distance between the bottom bearing and the top bearing. For a value F of 100 daN, the values of F1 and F2 are then respectively 225 daN and 125 daN.

The table below shows that bringing the bottom bearing 8 mm closer to the airfoil, the gain in reduced force is 17% and 30% respectively.

| | Prior art | Invention | Gain |
|---|---|---|---|
| F (daN) | 100 | 100 | |
| F1 (daN) | 225 | 187.5 | 17% |
| F2 (daN) | 125 | 87.5 | 30% |
| L (mm) | 50 | 42 | |
| L1 (mm) | 40 | 48 | |
| Moment | 5000 | 4200 | |

Figure 3:
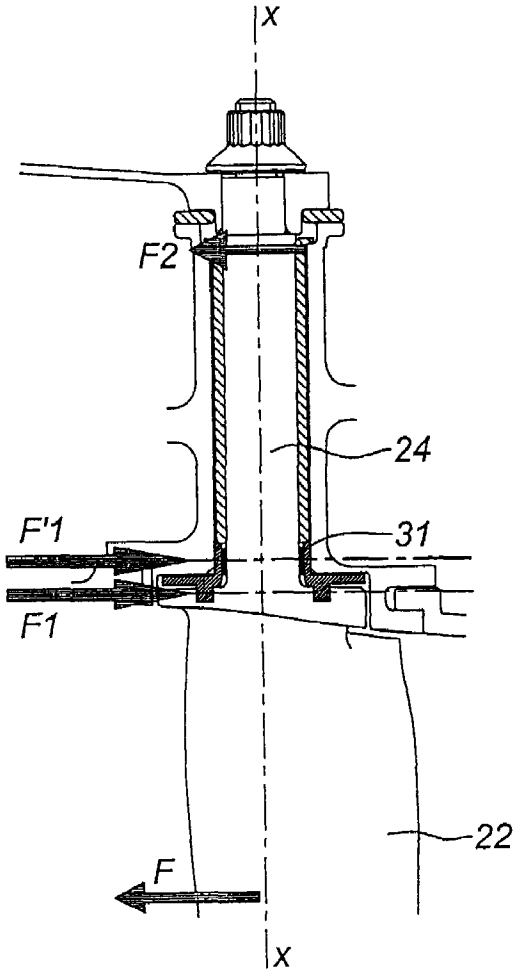
FIG. 3 shows a variable-setting stator blade with a guidance device according to a second embodiment.

FIG. 3 shows a variant of the invention according to which the bearing is kept at the bottom of the pivot relative to the preceding solution. With this bottom bearing duplicating the bearing integrated into the platform, the load is distributed between F1 and F1'. The reference numbers are the same as for the preceding solution. Note the additional bottom bearing formed by the interaction of the shrink-fitted band 31 mounted on the pivot 24 with the cylindrical portion 26*a* of the bush 26.

The invention claimed is:

1. A variable-setting stator blade guidance device in an axial turbomachine, the blade comprising an airfoil, a platform and a pivot by which the blade is rotably mounted in the casing of the turbomachine, the guidance device comprising:

a bush including a disk-shaped portion sandwiched between the casing and the platform;

a circular rib protruding from said disk-shaped portion; and a groove disposed in the platform, wherein the circular rib and the groove are configured to cooperate such that the circular rib is seated in the groove to form a bearing.

2. The guidance device as claimed in claim 1, further comprising a top bearing disposed between a top portion of the pivot and a housing of the top portion of the pivot in the casing.

3. The guidance device as claimed in claim 1, further comprising a supplementary bottom bearing disposed between a bottom portion of the pivot and a housing of the bottom portion of the pivot in the casing.

4. The guidance device as claimed in claim 1, wherein the bush includes a cylindrical portion disposed between the pivot and the casing.

5. The guidance device as claimed in claim 1, wherein the bush remains immobile relative to the casing when the blade rotates about its axis.

6. The guidance device as claimed in claim 1, wherein an upper surface of the disk-shaped portion directly faces the casing, and a lower surface of the disk-shaped portion directly faces the platform.

7. The guidance device as claimed in claim 1, wherein the circular rib radially protrudes from a lower surface of the disk-shaped portion towards a central axis of the turbomachine.

8. The guidance device as claimed in claim 1, wherein a cross-section of the circular rib is rectangular.

9. The guidance device as claimed in claim 1, wherein the radius of the bearing is selected such that friction between the circular rib and the groove does not disrupt operation of setting control means.

10. A turbomachine with variable-setting stator blades, each blade comprising a pivot by which each blade is cantilever-mounted in the casing of the turbomachine and a platform, the turbomachine comprising:

a bush including a disk-shaped portion sandwiched between the casing and the platform;

a circular rib protruding from said disk-shaped portion; and a groove disposed in the platform, wherein the circular rib and the groove are configured to cooperate such that the circular rib is seated in the groove to form a bearing.

11. A variable-setting stator blade guidance device in an axial turbomachine, the blade comprising an airfoil, a platform and a pivot by which the blade is rotably mounted in the casing of the turbomachine, the guidance device comprising:

a bush including a disk-shaped portion sandwiched between the casing and the platform;

a circular rib protruding from said disk-shaped portion;

a groove disposed in the platform; and a supplementary bottom bearing disposed between a bottom portion of the pivot and a housing of the bottom portion of the pivot in the casing, wherein the circular rib and the groove are configured to cooperate such that the circular rib is seated in the groove to form a bearing, and wherein the supplementary bottom bearing includes a shrink-fitted band mounted on the pivot.

* * * * *